United States Patent [19]

Breitschaft et al.

[11] Patent Number: 4,912,006

[45] Date of Patent: Mar. 27, 1990

[54] ELECTROSTATIC TONER

[75] Inventors: Walter Breitschaft, Mannheim; Erwin Czech, Biblis; Udo Mayer, Frankenthal; Guenther Seybold, Neuhofen; Horst Bruder, Ludwigshafen; Rainer Dyllick-Brenzinger, Weinheim, all of Fed. Rep. of Germany

[73] Assignee: BASF Aktiengesellschaft, Ludwigshafen, Fed. Rep. of Germany

[21] Appl. No.: 367,314

[22] Filed: Jun. 16, 1989

[30] Foreign Application Priority Data

Jun. 23, 1988 [DE] Fed. Rep. of Germany ..... 3821199

[51] Int. Cl.[4] ..... G03G 9/00

[52] U.S. Cl. ..... 430/110

[58] Field of Search ..... 430/110

[56] References Cited

U.S. PATENT DOCUMENTS 4,258,116 3/1981 Takasu et al. ..... 430/102

4,610,942 9/1986 Tashiki et al. ..... 430/59

*Primary Examiner*—Roland E. Martin

*Attorney, Agent, or Firm*—Oblon, Spivak, McClelland, Maier & Neustadt

[57] ABSTRACT

An electrostatic toner consists of a polymer a charge controlling component and an optional color-giving component, wherein the charge controlling agent component comprises one or more compounds of the formula '(I)',

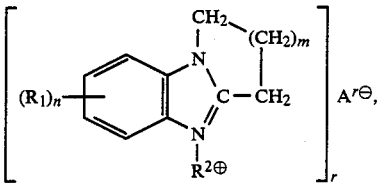

(I)

ps where $R^1$ is chlorine or methyl, $R^2$ is $C_4$–$C_{22}$-alkyl, benzyl or 2-phenylethyl, $A\ominus$ is an anion, n is 0, 1 or 2, m is 1 or 2 and r is 1 or 2.

9 Claims, No Drawings

ELECTROSTATIC TONER

DE-A-2,733,468 discloses benzimidazole compounds of the formula

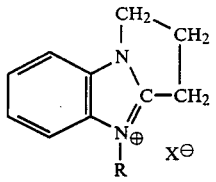

where R is $C_1$ to $C_{12}$-alkyl or benzyl.

Compounds (II) are used as components for preparing cationic dyes.

Electrostatic toners, in addition to a suitable polymer, color-giving components and further additives, contain in general compounds which stabilize the charge on the particles.

It is an object of the present invention to provide further toners which are highly suitable for electrostatic copying processes.

We have found that this object is achieved by an electrostatic toner consisting of a polymeric binder having a softening point within the range from 40° to 200° C., from 0.01 to 2% by weight, based on the toner, of a charge controlling component, and an optional color-giving component, wherein controlling the charge stabilizer component comprises one or more compounds of the formula (I)

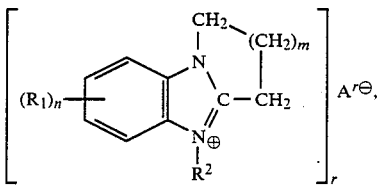

(I)

where $R^1$ is chlorine or methyl, $R^2$ is $C_4$–$C_{22}$-alkyl, benzyl or 2-phenylethyl, AΘ is one equivalent of an anion, n is 0, 1 or 2, m is 1 or 2 and r is 1 or 2.

Some toners according to the invention are notable for an approximately 50% higher charge in the positive direction compared with prior art toners.

In the formula (I), $R^2$ can be not only benzyl or phenylethyl but also $C_4$-$C_{22}$-alkyl. Specific examples of $R^2$ in this meaning are: n- and i-butyl, n- and i-pentyl, hexyl, heptyl, n- and i-octyl, 2-ethylhexyl, nonyl, decyl, dodecyl, tetradecyl, hexadecyl, stearyl, eicosyl and doeicosyl, the alkyl groups being linear or branched.

$R^2$ is preferably benzyl or $C_{10}$-$C_{22}$-alkyl, in particular $C_{12}$-$C_{22}$-alkyl.

Particular preference is given to toners that contain compounds (I) where $R^1$ is methyl, n is 0 or 1 and $R^2$ is $C_{10}$-$C_{22}$-alkyl, in particular $C_{12}$-$C_{22}$-alkyl.

Possible anions AΘ are the usual ones, for example FΘ, ClΘ, BrΘ, IΘ, $PF_6$Θ, $BF_4$Θ, formate, acetate, propionate, oxalate,

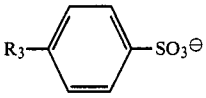

where $R^3$ is H or methyl and

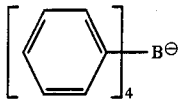

That is, r is these cases.

Particularly preferably, AΘ, is FΘ, ClΘ, BrΘ, $PF_6$Θ, $BF_4$Θ or IΘ and hence r is 1. The preparation of the toners is known. The Examples will explain the invention in more detail. Parts and percentages are by weight.

I. Preparation of compounds (I).

EXAMPLE 1

15.8 parts of pyrrolidino[1,2-a]benzimidazole and 13.2 parts of dimethyl sulfate were heated at the boil in 100 parts of ethanol for 3 hours. After the solvent had been distilled off at 40° C./12 mmHg, the residue was dissolved in 200 parts of water at 20° C., and 12.1 parts of sodium tetrafluoroborate were added. After cooling down to 5° C., the resulting precipitate was filtered off and washed with water. yield: 7 parts (=27% of theory) of a colorless powder of the formula

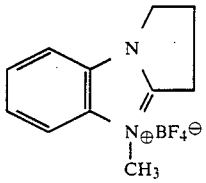

melting point 165°–170° C.

EXAMPLE 2

Example 1 was repeated, except that the pyrilidino[1,2-a]benzimidazole was replaced by 17.2 parts of 6-methylpyrrolidino[1,2-a]benzimidazole, affording 14 parts (=52% of theory) of a colorless powder of the formula

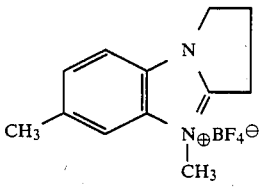

melting point 115° C.

EXAMPLE 3

15.8 parts of pyrrolidino[1,2-a]benzimidazole and 37.3 parts of 1-dodecyl bromide were heated at 140° C. for 4 hours. After cooling down to 20° C., the reaction product was stirred with 150 parts of ethyl acetate for 30 minutes, and the resulting precipitate was filtered off and washed with ethyl acetate, leaving 37 parts (=91% of theory) of a colorless powder of the formula

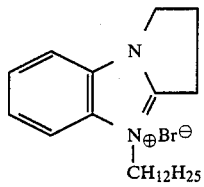

of melting point 65°-68° C.

EXAMPLE 4

16.3 parts of the product obtained as described in Example 3 were dissolved in 300 parts of water at 40° C., and 4.8 parts of sodium tetrafluoroborate were added. After cooling down to 5° C. the resulting precipitate was isolated by filtration, washed with water and dried, leaving 12 parts (=73% of theory) of a colorless powder of the formula

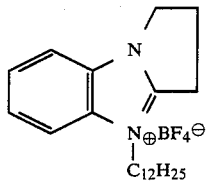

EXAMPLE 5

Example 3 was repeated, except that the 1-dodecyl bromide was replaced by 50 parts of 1-octadecyl bromide, affording 43 parts (≙88% of theory) of a colorless powder of the formula

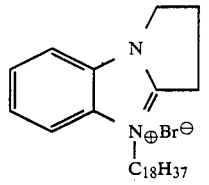

of melting point 77° C.

EXAMPLE 6

Example 4 was repeated, except that the product of Example 3 was replaced by 19.6 parts of the product of Example 5, affording 19 parts (≙95% of theory) of a colorless powder of the formula

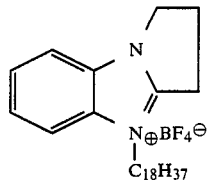

of melting point 115°-120° C.

II. Preparation and testing of toners

II.1 The following method was used to determine the electrostatic charge on a toner: To prepare a developer, 99% of an iron powder having particle sizes of from 75 to 175 μm, a medium particle size of 120μ and a spherical particle shape are accurately weighed out together with 1% of the toner, and the mixture was activated for 10 minutes on a roll mill. Thereafter the electrostatic charge on the developer is determined. About 5 g of the activated developer are introduced into a commercial q/m meter (from Epping GmbH, Neufahrn) into a hard blow off cell electrically connected to an electrometer. The mesh size of the sieves used in the measuring cell is 50 μm. This ensures that virtually all the toner is blown off, while the carrier remains in the measuring cell. A fast stream of air (about 4000 $cm^3$/min) and simultaneous aspiration is used to remove virtually all the toner from the carrier particles, the latter remaining in the measuring cell. The charge on the carrier registers on the electrometer. It corresponds to the amount of charge on the toner particles, only under the opposite sign. To calculate the q/m value, therefore, the absolute amount of q is used with the opposite sign. The measuring cell is weighed back to determine the weight of blown off toner, and the weight is used to calculate the electrostatic charge q/m.

The charge determined on the toners is summarized at the end of the toner examples (toners) in a table.

Toner 1

In a mixer, 94.0 parts of a copolymer of 70% of styrene and 30% of n-butyl methacrylate, 5 parts of carbon black and 1 part of stearylpyrrolidino[1,2]benzimidazolium bromide from Example 5 are thoroughly mixed, kneaded at 120° C., extruded and preground. Grinding in a fluid bed counter jet mill with a sifter wheel and subsequent sifting produces toner particles between 5-25 μm having a median particle size of 15 μm. A developer is prepared by weighing out 99 parts of the iron powder described at II.1 with 1 part of the toner and activating on a roll book for 10 minutes.

The electrostatic chargeability q/m is then determined with a q/m meter (Table 1).

Toner 2

The same method as described at Toner 1 is used to produce a toner by mixing 94.0% of the copolymer styrene and n-butyl methacrylate, 5% of carbon black and 1% of stearylpyrrolidino[1,2-a]benzimidazolium tetrafluoroborate from Example 6, kneading, pregrinding, jet milling and sifting. A developer is prepared by weighing out 99 parts of the iron powder described at II.1 with 1 part of the toner and activating on a roll book for 10 minutes.

Electrostatic chargeability q/m is then determined with a q/m meter (Table 1).

Toner 3

The same method as described at Toner 1 is used to produce a toner by mixing 94.0% of the copolymer styrene and n-butyl methacrylate, 5% of carbon black and 1% of stearylpyrrolidino[1,2-a]benzimidazolium chloride, kneading, pregrinding, jet milling and sifting. A developer is prepared by weighing out 99 parts of the iron powder described at II.1 with 1 part of the toner and activating on a roll book for 10 minutes.

Electrostatic chargeability q/m is then determined with a q/m meter (Table 1).

Toner 4

The same method as described at Toner 1 is used to produce a toner by mixing 94.0% of the copolymer styrene and n-butyl methacrylate, 5% of carbon black and 1% of stearylpyrrolidino[1,2-a]benzimidazolium iodide, kneading, pregrinding, jet milling and sifting. A developer is prepared by weighing out 99 parts of the iron powder described at II.1 with 1 part of the toner and activating on a roll book for 10 minutes.

Electrostatic chargeability q/m is then determined with a q/m meter (Table 1).

Toner 5

A toner is prepared as a +Toner 1 from 94 parts of copolymer styrene and n-butyl methacrylate, 5 parts of carbon black and 1 part of tetradecylpyrrolidino[1,-2Θa]benzimidazolium bromide. 1 part of the toner prepared in this manner is weighed out together with 99 parts of the iron powder described at II.1, the mixture is activated on a roll book for 10 minutes, and the electrostatic chargeability is determined with a q/m meter (see Table 1).

Toner 6

A toner is prepared as at Toner 1 from 94 parts of copolymer styrene and n-butyl methacrylate, 5 parts of carbon black and 1 part of tetradecylpyrrolidino[1,2-a]benzimidazolium tetrafluoroborate. A developer is prepared from 1 part of the toner thus produced and 99 parts of the iron powder described at II.1, and the electrostatic charge is determined (Table 1).

Toner 7

A toner prepared as described at Toner 1 contains 94 parts of the binder described in Example 1, 5 parts of carbon black and 1 part of dodecylpyrrolidino[1,2-a]benzimidazolium tetrafluoroborate. A developer is prepared as described at II.1 from 1 part of the toner described herein and 99 parts of iron powder and activated as at Toner 1, and the electrostatic chargeability q/m is determined with a q/m meter (Table 1).

Toner 8

A toner is prepared using as the charge controlling agent 1 part of decylpyrrolidino[1,2-a]benzimidazolium tetrafluoroborate. The developer prepared as described at II.1 had an electrostatic chargeability of +15 μC/q (Table 1).

Toner 9

A toner is prepared as at Toner 1 using as the charge controlling agent 1 part of n-hexylpyrrolidino[1,2-a]benzimidazolium tetrafluoroborate. The developer prepared as described at II.1 had an electrostatic chargeability of +11 μC/q (Table 1).

Toner 10 (Comparison)

A toner prepared as at Toner 1 with 1 part of n-propylpyrrolidino[1,2-a]benzimidazolium tetrafluoroborate as charge controlling agent was used to prepare a developer. The q/m value is +3 μC/g (Table 1).

Toner 11 (Comparison)

A toner prepared as at Toner 1 with 1 part of ethylpyrrolidino[1,2-a]benzimidazolium tetrafluoroborate as charge controlling agent is used to prepare a developer. Electrostatic chargeability is +3.1 μC./g (Table 1).

Toner 12 (Comparison)

A toner as a +Toner 1, 1 part of methylpyrrolidino[1,2-a]benzimidazolium tetrafluoroborate as charge controlling agent, is used to prepare a developer. The electrostatic chargeability is +2.7 μC/g (Table 1).

Toner 13 (Comparison)

A toner is prepared from 95 parts of styrene acrylate and 5 parts of carbon black. The developer prepared as at II.1 has an electrostatic chargeability of +3.1 μC/g (Table 1).

Toner 14 (Comparison)

The styrene acrylate described at Toner 1 is ground, and a fraction between 5 and 25 μm is classified out. 1% of binder is then mixed with 99 parts of iron powder and activated. The electrostatic chargeability is measured with a q/m meter (Table 1).

TABLE 1

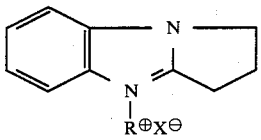

| Toner | R | XΘ | Color-giving component carbon black | q/m |
|---|---|---|---|---|
| 1 | $C_{18}H_{37}$ | BrΘ | Mogul L | +21.4 μC/g |
| 2 | $C_{18}H_{37}$ | $BF_4$Θ | Mogul L | +32.8 μC/g |
| 3 | $C_{18}H_{37}$ | ClΘ | Mogul L | +28 μC/g |
| 4 | $C_{18}H_{37}$ | IΘ | Mogul L | +15 μC/g |
| 5 | $C_{14}H_{25}$ | BrΘ | Mogul L | +19.8 μC/g |
| 6 | $C_{14}H_{29}$ | $BF_4$Θ | Mogul L | +25.8 μC/g |
| 7 | $C_{12}H_{25}$ | $BF_4$Θ | Mogul L | +18 μC/g |
| 8 | $C_{10}H_{21}$ | $BF_4$Θ | Mogul L | +15 μC/g |
| 9 | $C_6H_{13}$ | $BF_4$Θ | Mogul L | +11 μC/g |
| 10 | $C_3H_{10}$ | $BF_4$Θ | Mogul L | +3.0 μC/g comparison |
| 11 | $C_2H_5$ | $BF_4$Θ | Mogul L | +3.1 μC/g comparison |
| 12 | $CH_3$ | $BF_4$Θ | Mogul L | +2.7 μC/g comparison |
| 13 | — | — | Mogul L | +3.1 μC/g comparison |
| 14 | — | — | — | −1.4 μC/g comparison |

We claim:

1. An electrostatic toner consisting of a polymeric binder having a softening point within the range from 40° to 200° C., from 0.01 to 2% by weight, based on the toner, of a charge controlling component, and an optional color-giving component, wherein the charge controlling component comprises one or more compounds of the formula (I);

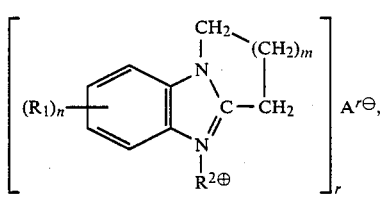

(I)

where $R^1$ is chlorine or methyl, $R^2$ is $C_4$-$C_{22}$-alkyl, benzyl or 2-phenylethyl, AΘ is one equivalent of an anion, n is 0, 1 or 2, m is 1 or 2 and r is 1 or 2.

2. A toner as claimed in claim 1, wherein $R^2$ is $C_{10}$-$C_{22}$-alkyl or benzyl.

3. A toner as claimed in claim 1, wherein $R^2$ is $C_{12}$-$C_{22}$-alkyl.

4. A toner as claimed in claim 1, wherein AΘ is FΘ, ClΘ, BrΘ, IΘ,

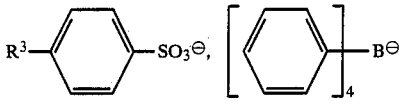

$PF_6\Theta$, $BF_4\Theta$, acetate, formate, oxalate or propionate and r is 1.

5. A toner as claimed in claim 2, wherein AΘ is FΘ, ClΘ, BrΘ, IΘ,

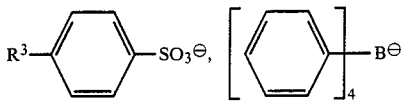

$Pf_6\Theta$, $BF_4\Theta$, acetate, formate, oxalate or propionate and r is 1.

6. A toner as claimed in claim 3, wherein AΘ is FΘ, ClΘ, BrΘ, IΘ,

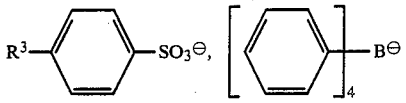

PFΘ, $BF_4\Theta$, acetate, formate, oxalate or propionate and r is 1.

7. A toner as claimed in claim 1, wherein AΘ is FΘ, ClΘ, BrΘ, IΘ, $PF_6\Theta$ or $BF_4\Theta$ and r is 1.

8. A toner as claimed in claim 2, wherein AΘ is FΘ, ClΘ, BrΘ, IΘ, $PF_6\Theta$ or $BF_4\Theta$ and r is 1.

9. A toner as claimed in claim 3, wherein AΘ is FΘ, ClΘ, BrΘ, IΘ, $PF_6\Theta$ or $BF_4\Theta$ and r is 1.

* * * * *